US012703991B2

(12) United States Patent
Maust et al.

(10) Patent No.: US 12,703,991 B2
(45) Date of Patent: Aug. 11, 2026

(54) FIRE SHELTER AND METHOD

(71) Applicants: David E. Maust, Grantsville, MD (US); Joshua K. Behling, Salem, UT (US); Linda Cantey, Napa, CA (US); Michael Berube, Marietta, GA (US)

(72) Inventors: David E. Maust, Grantsville, MD (US); Joshua K. Behling, Salem, UT (US); Linda Cantey, Napa, CA (US); Michael Berube, Marietta, GA (US)

(73) Assignee: Strata Products Worldwide, LLC, Sandy Springs, GA (US)

( * ) Notice: Subject to any disclaimer, the term of this patent is extended or adjusted under 35 U.S.C. 154(b) by 141 days.

(21) Appl. No.: 18/605,612

(22) Filed: Mar. 14, 2024

(65) Prior Publication Data

US 2025/0290342 A1 Sep. 18, 2025

(51) Int. Cl.
*E04H 9/14* (2006.01)

(52) U.S. Cl.
CPC ..... *E04H 9/14* (2013.01)

(58) Field of Classification Search
CPC .... E04H 9/14; E04H 9/04; E04H 9/10; E04H 9/145; E04H 9/16
See application file for complete search history.

(56) References Cited

U.S. PATENT DOCUMENTS 4,075,798 A * 2/1978 Tazaki ..... E04H 1/1261 52/168
4,301,631 A * 11/1981 Tazaki ..... E04H 1/1261 52/168
6,085,475 A * 7/2000 Parks ..... E04H 9/14 52/79.14
6,272,805 B1 * 8/2001 Ritter ..... E04C 2/044 52/309.7
8,695,285 B2 * 4/2014 Reinmann, Jr. ..... E04H 9/16 52/79.5
9,469,986 B2 * 10/2016 Connell ..... E04H 9/16
9,834,947 B2 * 12/2017 Beckmann ..... A62B 5/00
11,859,404 B2 * 1/2024 Yano ..... E04H 9/08
2012/0192503 A1 * 8/2012 Connell ..... E04H 1/1261 52/168
2013/0091783 A1 * 4/2013 Reinmann, Jr. ..... E04H 9/16 52/79.5
2014/0349562 A1 * 11/2014 Maust ..... E21F 11/00 454/172
2015/0152636 A1 * 6/2015 Connell ..... E04B 1/94 52/309.1
2016/0348386 A1 * 12/2016 Beckmann ..... F16K 17/02
(Continued)

*Primary Examiner* — Rodney Mintz
(74) *Attorney, Agent, or Firm* — Ansel M. Schwartz

(57) ABSTRACT

A shelter for protecting a person from fire and heat. The shelter has a roof, and front, right, left, and rear walls, each of which having a core made of a three-dimensional metal matrix embedded in insulation with concrete positioned about the walls and the roof. The concrete forming a continuous one-piece concrete layer enveloping the roof, and the walls, down to the base. The concrete layer forming a fire-resistant seal with the base about the walls, and roof which protects the person in the chamber from fire and heat at least more than 600 degrees Fahrenheit for at least 2 hours. A method for protecting a person from fire and heat. A method for building a shelter for protecting a person from fire and heat external to the shelter.

13 Claims, 9 Drawing Sheets

(56) References Cited

U.S. PATENT DOCUMENTS

| | | | | |
|---|---|---|---|---|
| 2017/0159317 | A1* | 6/2017 | Johansen | E04B 1/34321 |
| 2019/0323801 | A1* | 10/2019 | Bright | E04C 2/26 |
| 2021/0040738 | A1* | 2/2021 | Blackburn | E04B 1/355 |
| 2022/0023687 | A1* | 1/2022 | Eftekharzadeh | A62C 3/0214 |
| 2022/0195747 | A1* | 6/2022 | Yano | E04H 9/08 |
| 2023/0374784 | A1* | 11/2023 | Behling | E04C 2/28 |
| 2024/0003156 | A1* | 1/2024 | Lightburn | E04H 9/16 |
| 2025/0223803 | A1* | 7/2025 | Behling | E04C 2/46 |
| 2025/0290312 | A1* | 9/2025 | Maust | E06B 5/162 |
| 2025/0354377 | A1* | 11/2025 | Behling | E04C 2/28 |

* cited by examiner

FIRE SHELTER AND METHOD

FIELD OF THE INVENTION

The present invention is related to a shelter for protecting a person from fire and heat. More specifically, the present invention is related to a shelter for protecting a person from fire and heat having a roof and walls, each having a core made of a three-dimensional metal matrix embedded in insulation with a one-piece concrete layer enveloping the roof, and the walls. The concrete layer forming a fire-resistant seal which protects the person in the chamber from fire and heat at least more than 700 degrees Fahrenheit for at least 4 hours.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Whenever there is fire and heat in proximity to people and equipment, there is a need for protection for the people and the equipment from the fire and the heat. Regarding brush or forest fires that occur in densely populated communities, such as in California, these fires can move quickly without people having time to escape them. Once trapped, several hours can pass before the intense heat and fire dissipates enough for the trapped people to escape. What is needed in such circumstances is a portable fire shelter that can protect at least several people for several hours from the intense heat and fire which is convenient and unassuming.

BRIEF SUMMARY OF THE INVENTION

The present invention pertains to a shelter for protecting a person from fire and heat external to the shelter. The shelter comprises a base. The shelter comprises a front wall extending up from the base. The shelter comprises a right wall extending up from the base and alongside the front wall. The shelter comprises a left wall extending up from the base and alongside the front wall. The shelter comprises a rear wall extending up from the base and alongside the front wall and the left wall and opposing the right wall. The shelter comprises a roof atop the front wall, the right wall, the left wall, and the rear wall which together define a protected chamber from fire. The roof, the front wall, the right wall, and the left wall each having a core made of a three-dimensional metal matrix embedded in insulation with concrete positioned about the front wall, the right wall, the left wall, the rear wall and the roof. The concrete forming a continuous one-piece concrete envelope 90 enveloping the roof, the front wall, the right wall, the left wall and the rear wall down to the base. The concrete layer forming a fire-resistant seal with the base about the front wall, right wall, left wall, rear wall and the roof which protects the person in the chamber from fire and heat at least more than 600 degrees Fahrenheit for at least 2 hours. The shelter comprises a fire-resistant door disposed in either the front wall, the right wall, the left wall or the left wall which provides access to the chamber.

The present invention pertains to a method for protecting a person from fire and heat. The method comprises the steps of closing a fire-resistant door of a shelter. The shelter comprises a base. The shelter comprises a front wall extending up from the base. The shelter comprises a right wall extending up from the base and alongside the front wall. The shelter comprises a left wall extending up from the base and alongside the front wall. The shelter comprises a rear wall extending up from the base and alongside the front wall and the left wall and opposing the right wall. The shelter comprises a roof atop the front wall, the right wall, the left wall and the rear wall which together define a protected chamber from fire. The roof, the front wall, the right wall and the left wall each having a core made of a three-dimensional metal matrix embedded in insulation with concrete positioned about the front wall, the right wall, the left wall, the rear wall and the roof. The concrete forming a continuous one-piece concrete envelope 90 enveloping the roof, the front wall, the right wall, the left wall, and the rear wall down to the base. The concrete layer forming a fire-resistant seal with the base about the front wall, right wall, left wall, rear wall and the roof which protects the person in the chamber from fire and heat at least more than 600 degrees Fahrenheit for at least 2 hours. The shelter comprises a fire-resistant door disposed in either the front wall, the right wall, the left wall or the left wall which provides access to the chamber. There is the step of opening valves of compressed air cylinders in the shelter to flow the compressed air from the cylinders into the chamber of the shelter.

The present invention pertains to a method for building a shelter for protecting a person from fire and heat external to the shelter. The method comprises the steps of placing a front wall on a base so the front wall is extending up from the base. There is the step of placing a right wall on a base so the right wall is extending up from the base and alongside the front wall. There is the step of placing a left wall on a base so the left wall is extending up from the base and alongside the front wall. There is the step of placing a rear wall on a base so the rear wall is extending up from the base and alongside the front wall and the left wall and opposing the right wall. There is the step of placing a roof atop the front wall, the right wall, the left wall, and the rear wall which together define a protected chamber from fire. The roof, the front wall, the right wall and the left wall each having a core made of a three-dimensional metal matrix embedded in insulation with concrete positioned about the front wall, the right wall, the left wall, the rear wall and the roof. There is the step of pouring concrete onto the roof which flows over the roof onto the front, right, left and rear walls and down to the base, forming a continuous one-piece concrete envelope 90 enveloping the roof, the front wall, the right wall, the left wall and the rear wall down to the base. The concrete layer forming a fire-resistant seal with the base about the front wall, right wall, left wall, rear wall and the roof which protects the person in the chamber from fire and heat at least more than 600 degrees Fahrenheit for at least 2 hours. There is the step of attaching a fire-resistant door disposed in either the front wall, the right wall, the left wall or the left wall which provides access to the chamber.

DETAILED DESCRIPTION OF THE INVENTION

Figure 12:
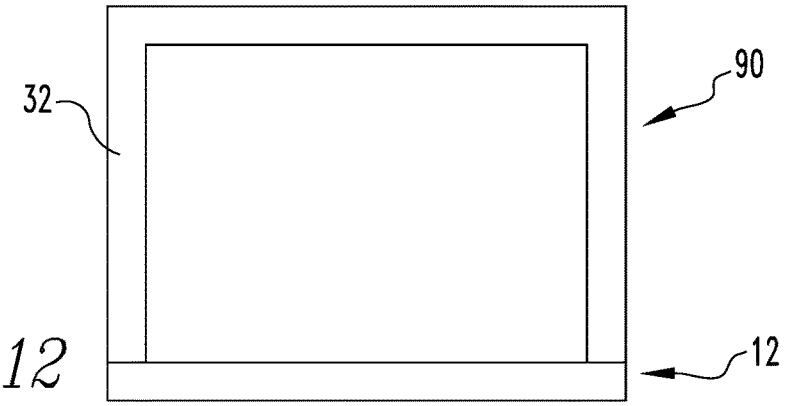
FIG. 12 is a cross-sectional from view of the concrete envelope on the base.

Referring now to the drawings wherein like reference numerals refer to similar or identical parts throughout the several views, and more specifically to FIGS. 1-4 thereof, there is shown a shelter 10 for protecting a person from fire and heat external to the shelter 10. The shelter 10 comprises a base 12. The shelter 10 comprises a front wall 14 extending up from the base 12. The shelter 10 comprises a right wall 16 extending up from the base 12 and alongside the front wall 14. The shelter 10 comprises a left wall 18 extending up from the base 12 and alongside the front wall 14. The shelter 10 comprises a rear wall 20 extending up from the base 12 and alongside the front wall 14 and the left wall 18 and opposing the right wall 16. The shelter 10 comprises a roof 22 atop the front wall 14, the right wall 16, the left wall 18, and the rear wall 20 which together define a protected chamber 24 from fire. The roof 22, the front wall 14, the right wall 16, and the left wall 18 each having a core 26 made of a three-dimensional metal matrix 28 embedded in insulation 30 with concrete 32 positioned about the front wall 14, the right wall 16, the left wall 18, the rear wall 20, and the roof 22. The concrete 32 forming a continuous one-piece concrete 32 envelope 90 enveloping the roof 22, the front wall 14, the right wall 16, the left wall 18, and the rear wall 20 down to the base 12, as shown in FIG. 12. The concrete 32 envelope 90 forming a fire-resistant seal with the base 12 about the front wall 14, right wall 16, left wall 18, rear wall 20 and the roof 22 which protects the person in the chamber 24 from fire and heat at least more than 600 degrees Fahrenheit and preferably 700 degrees Fahrenheit for at least 2 hours and preferably 4 hours and even 8 hours. The shelter 10 comprises a fire-resistant door 34 disposed in either the front wall 14, the right wall 16, the left wall 18, or the left wall 18 which provides access to the chamber 24. The insulation 30 may be a fire-resistant and heat limiting plastic or foam, such as polystyrene, that is much lighter weight per cubic ft than concrete. The size of the shelter 10 may be limited only by the contents being protected and for how long. Generally, there is 2 cubic feet of released air per occupant. For instance, for six adults to be sustained safely for 4 hours, there is a release of 12 CFM of air over 4 hours. This same rate is also applicable for 2 hours or 8 hours, depending how long the shelter 10 is to provide protection. The size of the shelter 10 for six adults is about 110 in. long and about 98 in. wide and about 120 in high. The chamber 24 is about 82 in. wide and about 94 in. long and about 108 in. high.

The shelter 10 may include a heat reflective layer 36 disposed on an external surface of each of the front wall 14, right wall 16, the left wall 18, the rear wall 20 and the roof 22. The shelter 10 may include an inflammable layer 38 in spaced relation to the reflective layer 36 on each of the front wall 14, the right wall 16, the left wall 18, the rear wall 20 and the roof 22 forming an airgap 40 between the inflammable layer 38 and the reflective layer 36 in each of the front wall 14, the right wall 16, the left wall 18, the rear wall 20, and the roof 22.

The shelter 10 may include inflammable heat resistant spacers 42 attached to and between the reflective layer 36 and the inflammable layer 38 of the front wall 14, the right wall 16, the left wall 18, the rear wall 20 and the roof 22 which maintain the inflammable layer 38 in spaced relation with the reflective layer 36 to define the airgap 40; and fasteners 44 extending through the inflammable layer 38, the spacers 42, the reflective layer 36 and the front wall 14, the right wall 16 the left wall 18, the rear wall 20, and the roof 22 to fix the inflammable layer 38, the spacers 42, and the reflective layer 36 in place with the front wall 14, the right wall 16, the left wall 18, the rear wall 20, and the roof 22. The shelter 10 may include a cylinder storage section 46 for storing compressed air cylinders 47 to provide air to the chamber 24.

Figure 5:
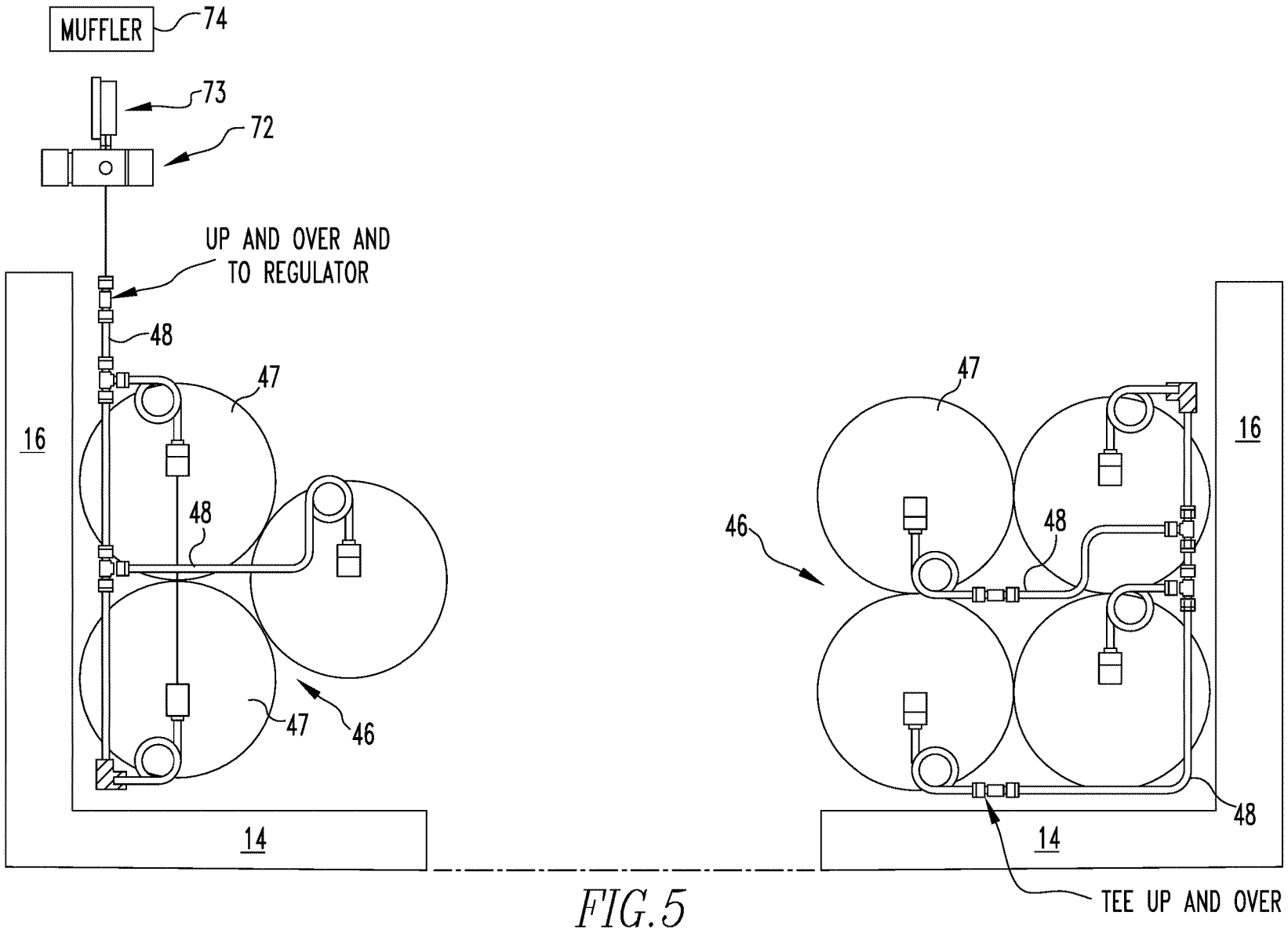
FIG. 5 is a representation of the plumbing connected to the pressurized air cylinders inside the chamber.

The shelter 10 may include plumbing 48 disposed in the chamber 24 to attach to the cylinders to control air flow out of the cylinders into the chamber 24, as shown in FIG. 5. The shelter 10 may include a hollow pipe 50 extending up from a hole 84 in the base 12. The pipe 50 having a top 52 and a bottom 54. The top 52 having a one-way exhaust valve 56 through which air from the chamber 24 enters and vents through the pipe 50 and out through the base 12. The bottom 54 of the pipe 50 attached to the base 12 and in fluidic communication to outside the base 12. The shelter 10 may include a release port 58 for the compressed air from the air cylinders to flow into the chamber 24. The release port 58 in fluidic communication with the plumbing 48.

Figure 6:
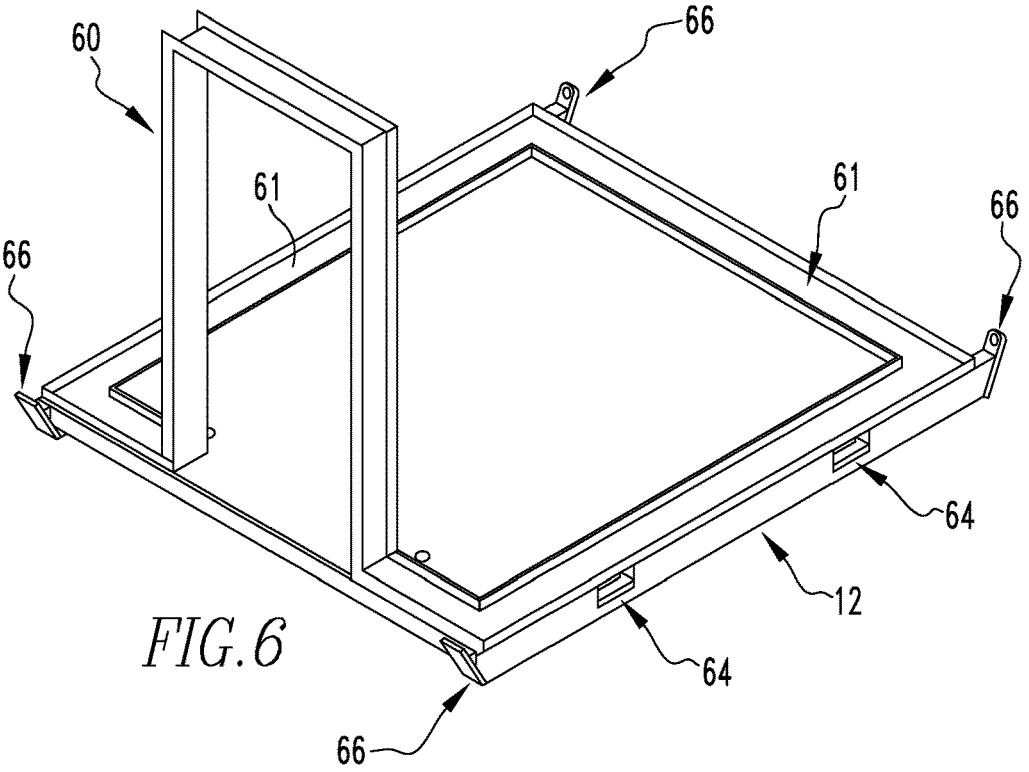
FIG. 6 is a perspective view of the base with the doorframe.
Figure 7:
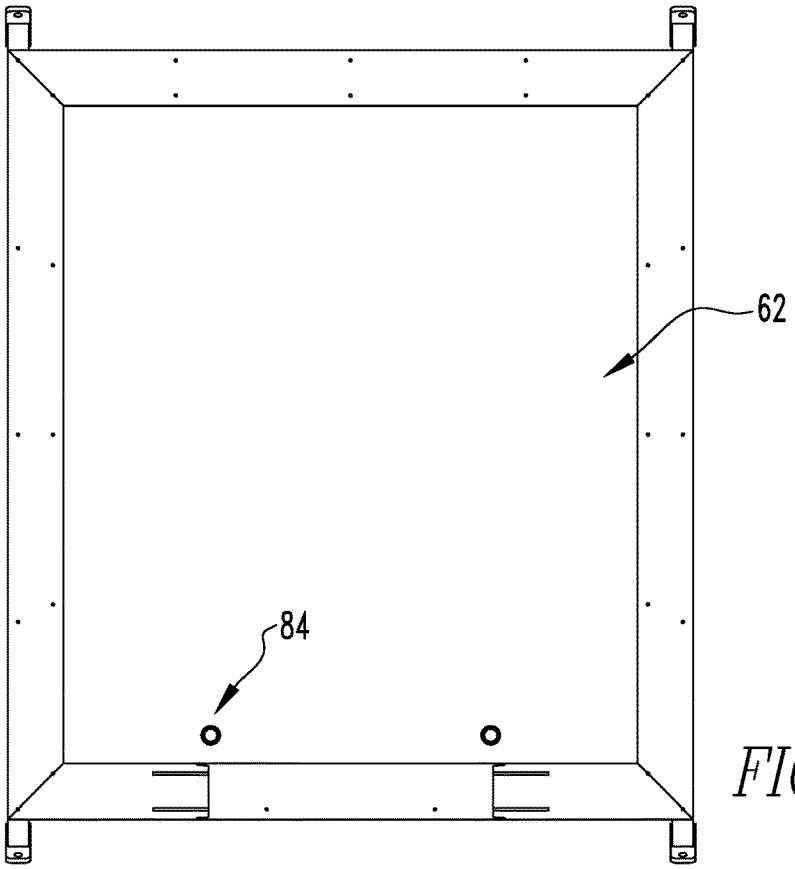
FIG. 7 is an overhead view of the base.

The release port 58 may be disposed adjacent the base 12 and the rear wall 20, and the pipe 50 is disposed adjacent the front wall 14 and opposing the release port 58 with the one-way exhaust valve 56 adjacent the roof 22 so isentropic cooling provided by the expansion of the compressed breathing air occurs. The inflammable layer 38 may be formed of cement board. The reflective layer 36 may be disposed on the external surface of each of the front wall 14, right wall 16, the left wall 18, and the rear wall 20 is one piece. The shelter 10 may include a metal frame 60 in the front wall 14 to which the door 34 is attached, as shown in FIG. 6 and FIG. 7. The base 12 may include a steel platform 62 with fork pockets 64 and lifting eye 66 at each corner for lifting the shelter 10. The core 26 of each wall and the roof 22 may include an EVG panel.

The present invention pertains to a method for protecting a person from fire and heat. The method comprises the steps of closing a fire-resistant door 34 of a shelter 10. The shelter 10 comprises a base 12. The shelter 10 comprises a front wall 14 extending up from the base 12. The shelter 10 comprises a right wall 16 extending up from the base 12 and alongside the front wall 14. The shelter 10 comprises a left wall 18 extending up from the base 12 and alongside the front wall 14. The shelter 10 comprises a rear wall 20 extending up from the base 12 and alongside the front wall 14 and the left wall 18 and opposing the right wall 16. The shelter 10 comprises a roof 22 atop the front wall 14, the right wall 16, the left wall 18 and the rear wall 20 which together define a protected chamber 24 from fire. The roof 22, the front wall 14, the right wall 16 and the left wall 18 each having a core 26 made of a three-dimensional metal matrix 28 embedded in insulation 30 with concrete 32 positioned about the front wall 14, the right wall 16, the left wall 18, the rear wall 20 and the roof 22. The concrete 32 forming a continuous one-piece concrete 32 envelope 90 enveloping the roof 22, the front wall 14, the right wall 16, the left wall 18, and the rear wall 20 down to the base 12. The concrete 32 envelope 90 forming a fire-resistant seal with the base 12 about the front wall 14, right wall 16, left wall 18, rear wall 20 and the roof 22 which protects the person in the chamber 24 from fire and heat at least more than 600 degrees Fahrenheit and preferably 700 degrees Fahrenheit for at least 2 hours and preferably 4 hours. The shelter 10 comprises a fire-resistant door 34 disposed in either the front wall 14, the right wall 16, the left wall 18 or the left wall 18 which provides access to the chamber 24. There is the step of opening valves of compressed air cylinders in the shelter 10 to flow the compressed air from the cylinders into the chamber 24 of the shelter 10.

The present invention pertains to a method for building a shelter 10 for protecting a person from fire and heat external to the shelter 10. The method comprises the steps of placing a front wall 14 on a base 12 so the front wall 14 is extending up from the base 12. There is the step of placing a right wall 16 on a base 12 so the right wall 16 is extending up from the base 12 and alongside the front wall 14. There is the step of placing a left wall 18 on a base 12 so the left wall 18 is extending up from the base 12 and alongside the front wall 14. There is the step of placing a rear wall 20 on a base 12 so the rear wall 20 is extending up from the base 12 and alongside the front wall 14 and the left wall 18 and opposing the right wall 16. There is the step of placing a roof 22 atop the front wall 14, the right wall 16, the left wall 18 and the rear wall 20 which together define a protected chamber 24 from fire. The roof 22, the front wall 14, the right wall 16 and the left wall 18 each having a core 26 made of a three-dimensional metal matrix 28 embedded in insulation 30 with concrete 32 positioned about the front wall 14, the right wall 16, the left wall 18, the rear wall 20 and the roof 22. There is the step of pouring concrete 32 onto the roof 22 which flows over the roof 22 onto the front, right, left and rear walls 14, 16, 18, 20 and down to the base 12, forming a continuous one-piece concrete 32 envelope 90 enveloping the roof 22, the front wall 14, the right wall 16, the left wall 18 and the rear wall 20 down to the base 12. The concrete 32 envelope 90 forming a fire-resistant seal with the base 12 about the front wall 14, right wall 16, left wall 18, rear wall 20 and the roof 22 which protects the person in the chamber 24 from fire and heat at least more than 600 degrees Fahrenheit and preferably 700 degrees Fahrenheit for at least 2 hours and preferably 4 hours and even 8 hours. There is the step of attaching a fire-resistant door 34 disposed in either the front wall 14, the right wall 16, the left wall 18 or the left wall 18 which provides access to the chamber 24.

In the operation of the invention, the shelter 10 protects inhabitants for at least 2 hours and preferably 4 hours and even 8 hours from heat and fire at least 600 degrees Fahrenheit and at least 700 degrees Fahrenheit, and preferably at least 1500 degrees Fahrenheit and at least 2000 degrees Fahrenheit. The wall/roof 22 thickness is approximately 7" to 11" and preferably 9" thick. Starting from the inside, there is about 2" of concrete 32 with embedded steel mesh, about 4" of foam insulation 30, then about 2" of concrete 32 with embedded steel mesh, radiant barrier foil, about a ¾" air space created with steel furring, then cement board or other non-flammable siding on the outer surface. The concrete 32 may be between 1" and 3" and the foam insulation may be between 3" and 5". The air space may be between ¼" and 1".

Figure 13:
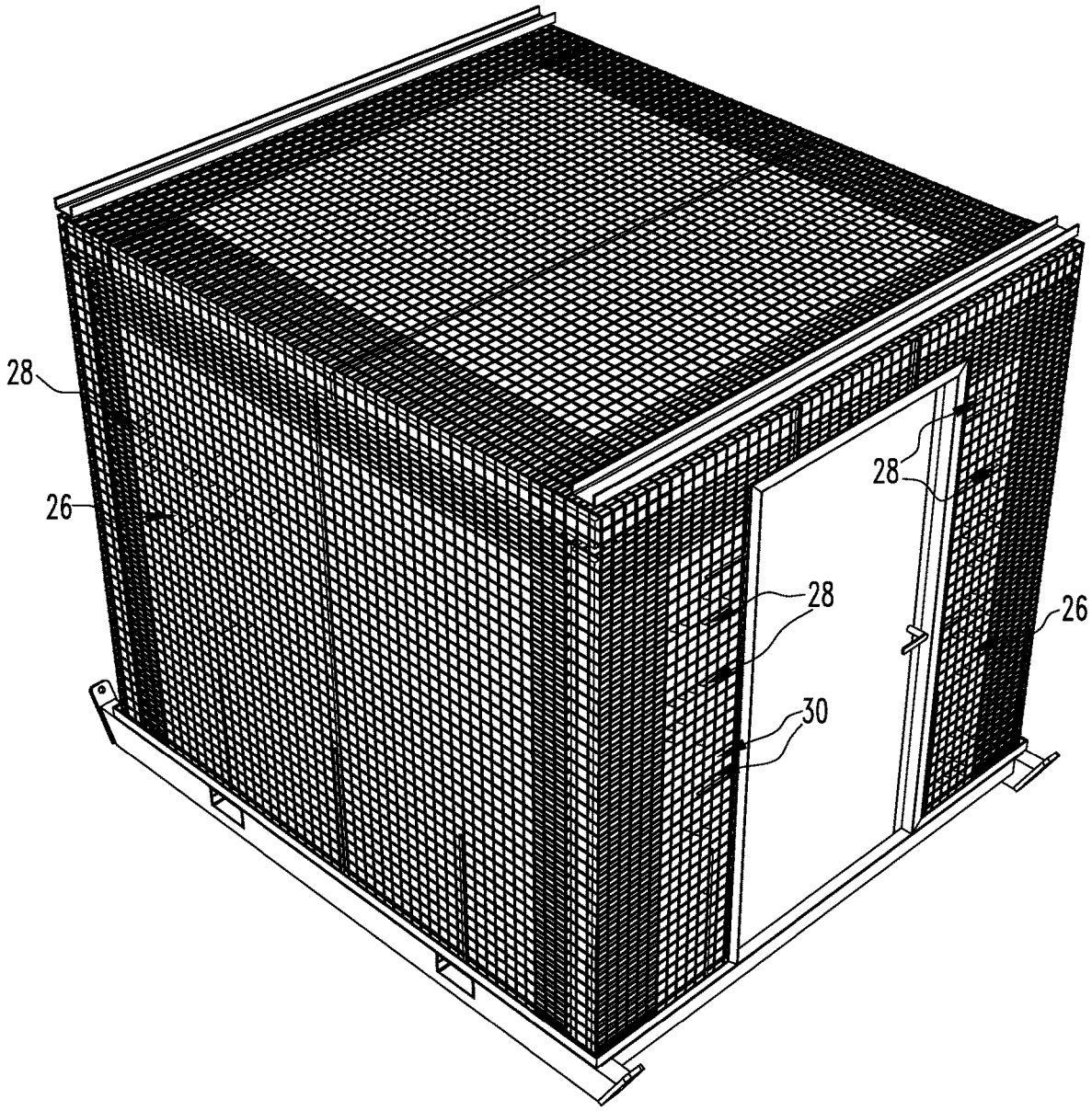
FIG. 13 is a perspective view of the core walls.

The walls comprising the three-dimensional panels, such as EVG panels which can be purchased from Strata Products Worldwide, LLC., are formed while in position on the base 12. See FIG. 13, which shows the cores 26 of the walls, here EVG panels, in place on the base 12 ready for forms to be placed around them for the concrete 32 pouring. The roof 22 is formed separately and then placed on top of the 4 walls. To prevent heat and gases from getting in through any seams, concrete 32 is poured onto the completed roof 22 and the completed walls. The concrete 32 is a continuous pour which eliminates any seams except where it meets the base 12. The concrete 32 forms a one-piece envelope 90, enveloping the chamber 24 from the base 12 up. Alternatively, only the interior concrete layer may be formed on the 4 walls and the roof 22, and then after the roof 22 is positioned on the 4 walls, the concrete is poured so the concrete fills the outer side of the roof 22 and spills over and fills the outer side of each of the 4 walls so the one-piece concrete envelope 90 is formed. The concrete 32 is poured tight to the steel base 12 and door frame 60. The door 34 is welded to the frame 60 and non-flammable sealant applied to all joints. Additionally, the released compressed air provides a constant positive pressure to the chamber 24 relative to outside the shelter 10 throughout the entire desired period, such as a 4-hour period once turned open to further insure none of the external atmosphere enters the chamber.

The shelter 10 is bermed around the perimeter with dirt/sand to prevent migration of heat through the base 12. Additionally, the shelter 10 is preferably installed with a 30' perimeter clear of potential fuel, brush, trees, dead limbs, etc. to further lower the potential fire and heat to which the shelter 10 may be exposed. Therefore, the potential of exposure of elevated heat at floor level will be minimal at worst.

Figure 8:
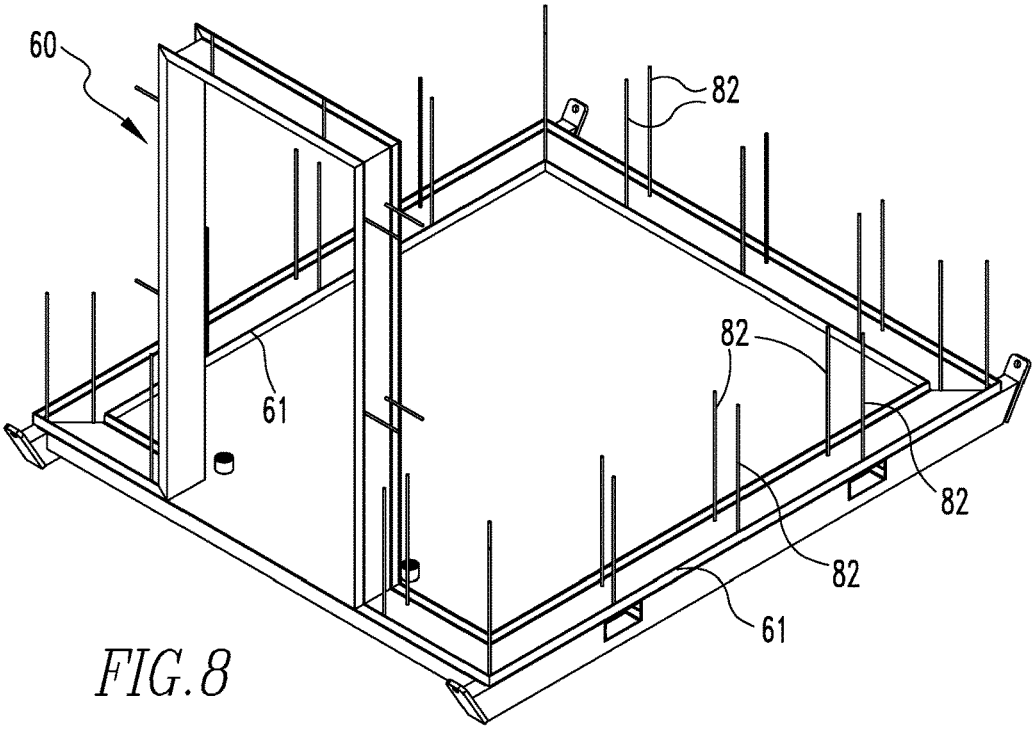
FIG. 8 is a perspective view of the doorframe and mount with rebar poles.

The individual EVG panels are cut to shape as necessary, for instance to accommodate the door frame 60, and positioned on the base 12. The base 12 has rebar poles 82 extending upwards between 1 and 4 ft from the base 12, around the perimeter of the base 12, as shown in FIG. 8. The rebar poles 82 serve to align the EVG panels in the proper position on the base 12. Preferably there are two opposing adjacent rebar pole 82 pairs staggered about the base 12 perimeter with at least one rebar pole 82 pair for each EVG panel. Each EVG panel is placed on the base 12 so one rebar pole 82 of the rebar pole 82 pair fits into the metal matrix 28 extending from the insulation 30 on one side, and the other rebar pole 82 of the rebar pole 82 pair fits into the metal matrix 28 extending from the other side of the insulation 30. The door frame 60 includes a support 61 which extends around the perimeter of a platform 62 of the base 12, from one side of the frame 60 to the other side of the frame 60. The rebar poles 82 are welded to the support 61 and the support 61 is in turn bolted or welded to the platform 62 and becomes part of the platform 62. The corners of each of the EVG panel walls are next connected to each other. Then forms are installed inside and out of each EVG panel in place on the base 12, with metal reinforcement mesh positioned in the forms outside the insulation 30, and concrete 32 is poured from the top 52. The forms are preferably aluminum and extend from the base 12 to above the EVG panels. The EVG panels forming the roof 22 are separately joined together and positioned in forms with metal reinforcement mesh, and have concrete 32 poured to them.

After the concrete 32 has properly cooled of the walls and the roof 22, depending on which one piece concrete envelope 90 forming method is used, the forms are removed, or the roof 22 is placed on top of the walls and secured to the walls, and the concrete poured to form the one-piece concrete envelope 90 about the chamber 24. A first reflective strip is placed on the roof 22 having a length extending from the top of the frame 60, across the roof 22 and partially down the rear side 20. A second reflective strip is placed on the roof 22 having a length extending partially down the right side 16, across the roof 22 and partially down the left side 18. The first and second reflective strips have a width which covers the width of the roof 22. A third reflective strip is wrapped around the front wall 14, right wall 16, rear wall 20 and left wall 18 from one side of the door frame 60 to the other side of the door frame 60, and extending from the base 12 to the roof 22, and overlapping the portions of the first and second reflective strips which extend past the roof 22 and downward. In this way the first, second and third reflective strips from a complete reflective layer 36 about the chamber 24 from the base 12 upwards and across the walls and roof 22. Metal furring strips, which also serve as spacers 42, are fastened to the walls and roof 22 at regular intervals, with the first, second and third reflective strips also fastened to the walls with the metal furring strips. The first and second reflective strips are also fastened to the roof 22 with metal furring strips, with the reflective strips positioned between the furring strips and the walls.

The reflective layer 36 is a heavy-duty radiant barrier that reflects/blocks 95% of the radiant heat, such as Radiant-GUARD®. The reflective layer 36 is used under metal, slate, cement, clay, or any other roofing material, with preferably a ¾" airspace in front of the reflective layer 36. The reflective strips are obtained from 48" wide rolls. Joints are taped with foil tape. The reflective strips are secured to the outer surface of the concrete 32 walls and roof 22 with metal furring strips and concrete screws.

Figure 9:
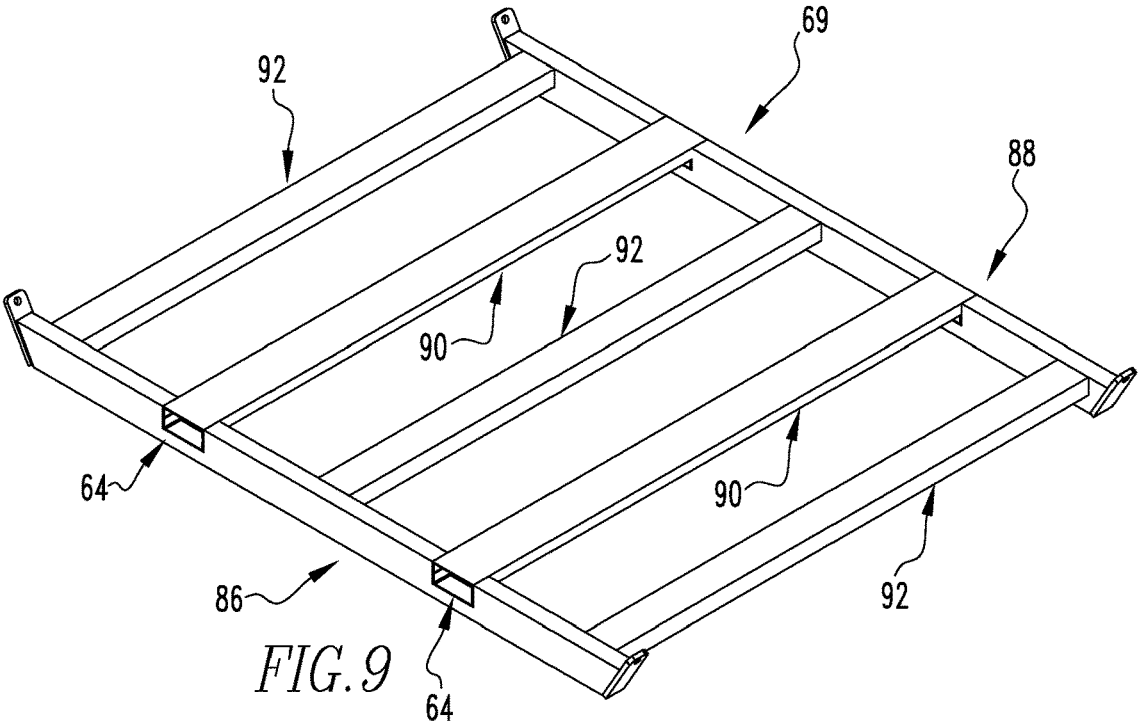
FIG. 9 is a perspective view of the skeleton of the base.
Figure 10:
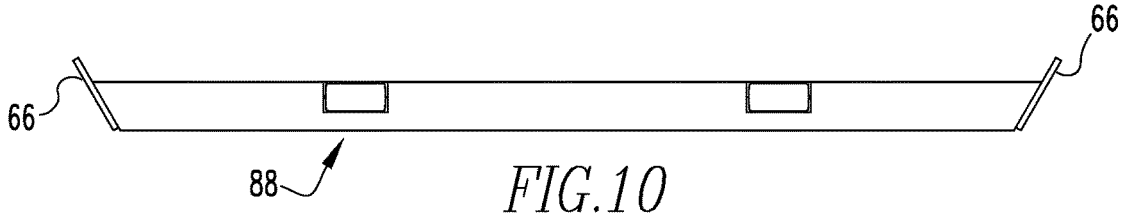
FIG. 10 is a side view of a longitudinal bracket of the skeleton.

The base 12 is a welded steel platform 62 with fork pockets 64 and lifting eye 66 at each of the 4 corners to accommodate transport, loading and final positioning, as shown in FIGS. 6 and 7. The base 12 is formed of a skeleton 69, as shown in FIG. 9, with the platform 62 on the skeleton 69. The right longitudinal bracket 86 and left longitudinal bracket 88 of the skeleton 69 under the right and left walls 16, 18, respectively, have c shaped cutouts in which channels 90 are positioned and extend between the right and left longitudinal brackets. FIG. 10 shows a longitudinal bracket with a lifting eye 66 on each end of the bracket. In the middle between the channels 90 and adjacent the ends of the right and left longitudinal brackets are tubes 92 extending between the right and left longitudinal brackets. When the platform 62 is fastened or welded to the skeleton 69, the base 12 is formed. With the shelter 10 bermed with earth and the 30' radius cleared of fuel, heat gain via the steel platform 62 will be insignificant. In addition to the above, for the safety of the occupants in the chamber 24 are the following features:

Chemical toilet 70
Battery powered lighting with 10-year shelf-life batteries
Fire extinguisher
First Aid Kit
Battery power strobe light
Non-slip cushioned floor matting
Cabinets 80 for storage of safety and other equipment.

The inflammable layer 38 is the outer layer and is preferably but not necessarily fiber cement siding. It can be any inflammable skin. Fiber cement board siding is produced by several manufacturers. Hardie Plank is one of the available brands of fiber cement board siding which can be purchased. Steel siding could be used as well.

Figure 1:
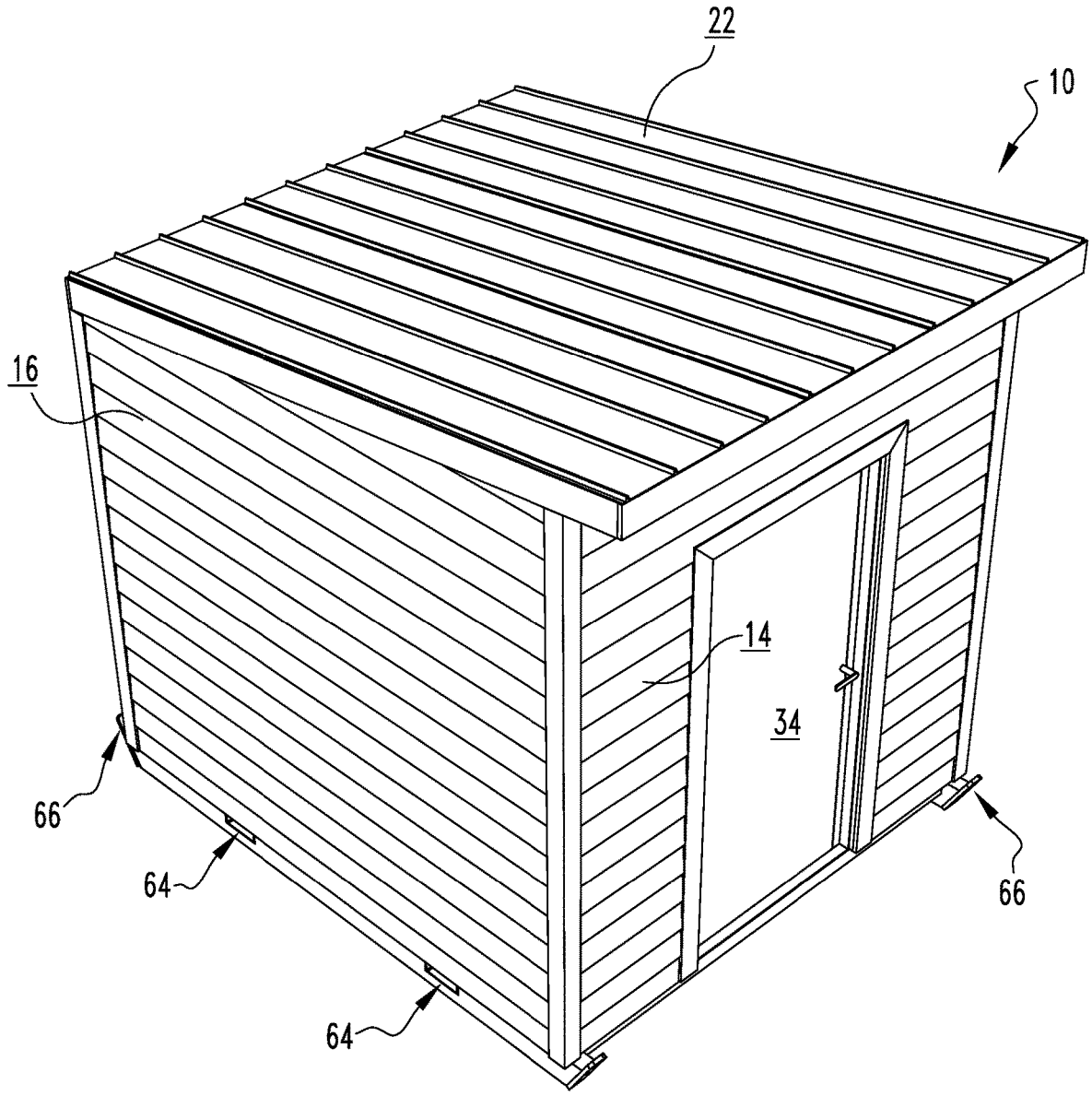
FIG. 1 is a perspective view of a shelter of the present invention.
Figure 2:
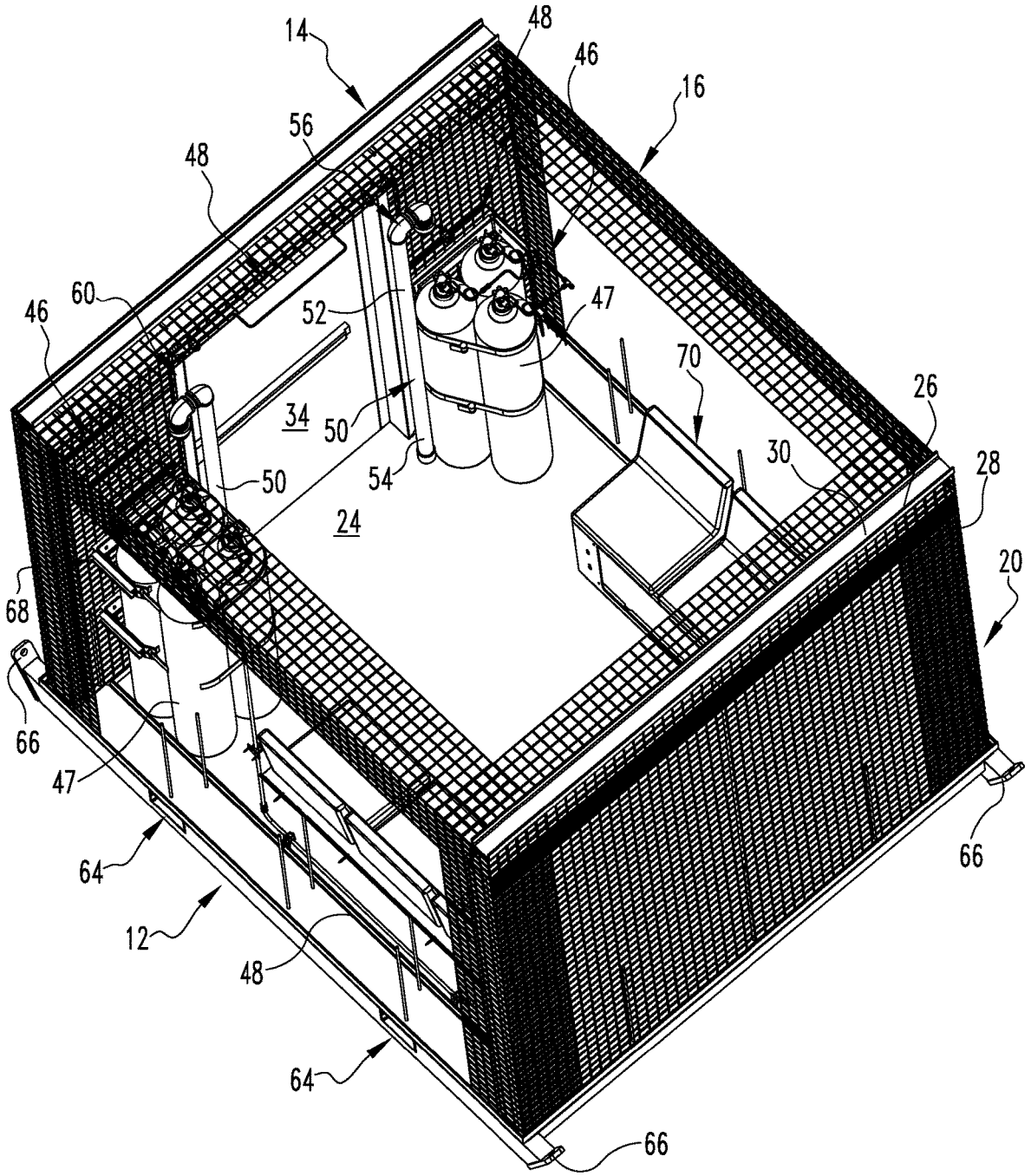
FIG. 2 is an overhead perspective cut away view of a chamber of the shelter with only some of the cores of the walls.
Figure 3:
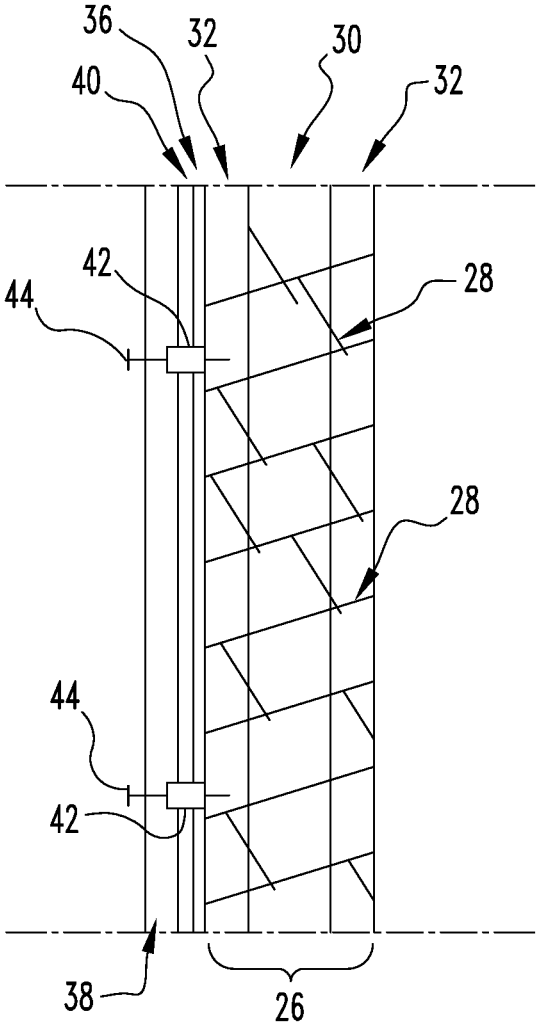
FIG. 3 is a cutaway side view representation of a wall or roof.
Figure 4:
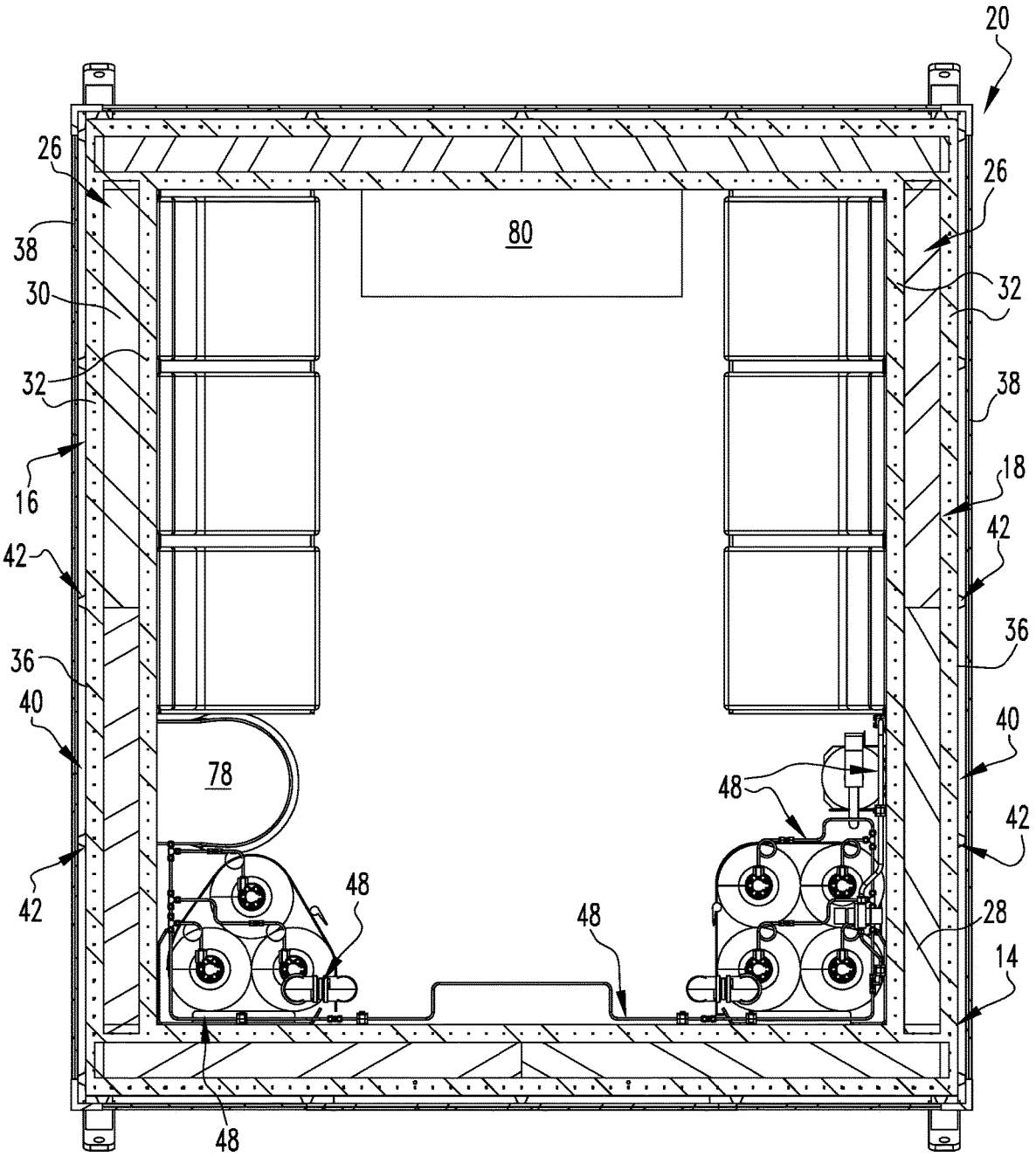
FIG. 4 is an overhead view of the shelter with the roof removed.
Figure 11:
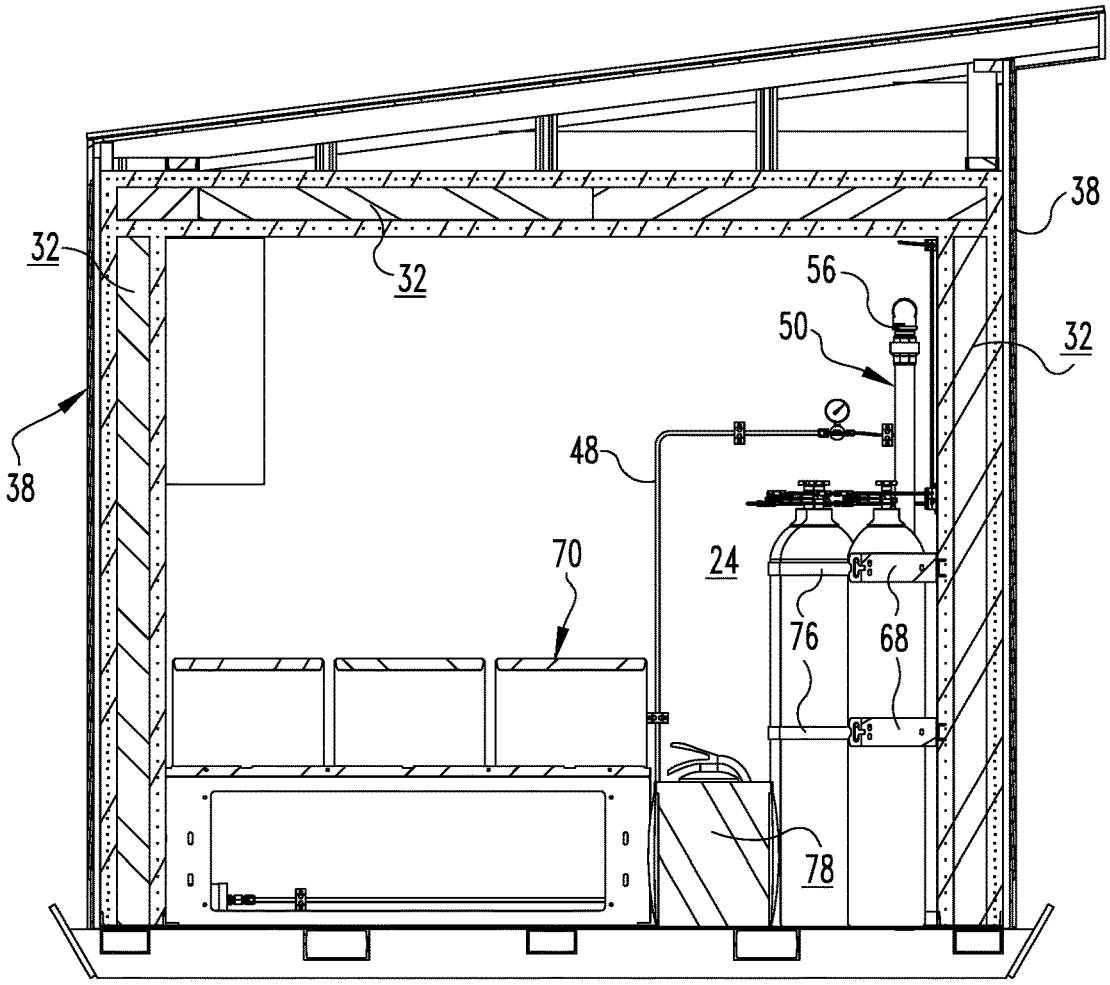
FIG. 11 right side cutaway view of the shelter showing the chamber.

Breathable air is provided via 4500 PSI cylinders 47. Seven cylinders 47, as shown in FIGS. 2, 4 and 11 are required to sustain 6 adults for 4 hours. The cylinders 47, three on the right side and four on the left side, are held by cylinder brackets 68 mounted into the corners formed by the front wall 14 and the right wall 16, and the front wall 14 and the left wall 18. Straps 76 attached to the cylinder brackets 68 hold the cylinders 47 in place. The compressed air is released low and in the rear of the chamber 24 and one-way exhaust valves 56 are located high and in the front of the chamber 24 at the top of pipes which extend up from holes 84 in the base 12 and which are vented through the holes 84 in the base 12 so there is no exposure to fire/flames. This maximizes the effect of the isentropic cooling provided by the expansion of the compressed breathing air. This is also important to maintain a safe temperature inside the chamber 24 over the 4-hour designed duration. The volume of air has been designed to both maintain adequate oxygen level, maintain CO2 levels under 1% and a safe temperature level. The volume of compressed air released is controlled by a suitable regulator and appropriately sized orifice to simplify the operation of the chamber 24. The cylinders 47 on the right side of the shelter 10 has plumbing which extends from the cylinders 47 up over the door 34 and merges through a valve with the plumbing extending from the cylinders 47 on the left side to form one flow line to the rear of the shelter 10. The air flows from the cylinders 47, through the manifold 72, to a regulator 73 that controls the pressure, as shown in FIG. 5, then through an orifice to control the flow rate down the left side of the chamber 24 then under the seat 70 and is released into the atmosphere beneath the seat 70, thus displacing the air (including expelled CO2 & heated air) in the chamber 24 out the two pressure relief valves 56 near the ceiling on either side of the door 34. The pipes 50 vent the air passing through the pressure relief valves 56 to outside and underneath the shelter through holes 84 in the base, as shown in FIG. 7, that the hollow pipes 50 extend into and below the base 12. Activation is accomplished simply by opening the 7-cylinder valves. The air is released into the chamber 24 through a muffler 74 to reduce noise level. There is 2 cubic feet of released air per occupant. For six adults to be sustained safely for 4 hours, there is a release of 12 CFM of air over 4 hours. Seating for 6 occupants is provided along with food & potable water with a 10-year from date-of-manufacture shelf life.

Additional features may be included with the shelter 10. Battery powered air conditioning for additional cooling of the chamber 24. The exhaust and intake for the condenser side of the AC will vent through the floor. The internal air will be recirculated through the evaporator side of the AC unit. An example is the EcoFlow 5,100 BTU Portable Air Conditioner.

Battery backup power unit for operation of other equipment, charging phones, etc. The unit will remain on standby connected to power, in garage or other on-site location in close proximity to the shelter 10, then carried to the shelter 10 when fire danger requires the use of the shelter 10.

Emergency Position Indicating Radio Beacon (EPIRB) and GPS emergency location equipment may be stored in the chamber 24 and available for use as needed.

Remote cameras for viewing external conditions may be included in the Shelter 10. The cameras may be embedded in each of the walls and roof 22 and communicate wirelessly with a controller and display in the chamber 24. Alternatively, small metal inspection tubes that are plugged on the inside which accesses the chamber 24 to prevent path for heat/smoke ingress in each wall and roof 22, or selective locations may be used for a bore camera to extend into and through to observe the outside of the shelter 10. An example of a bore camera which could be used is the Inspection Camera, Triple Lens Teslong Borescope with 6" IPS Split Screen, WiFi Endoscope Camera with Light IP67 Waterproof Flexible Cable Scope Camera for Automotive/Home/Wall/Pipe/Car (16.4 ft).

Remote temperature sensing system for monitor external temperatures. Sensors will be embedded in the exterior wall surface of the shelter 10 and connected to a wall hung battery powered display in the chamber 24 either by WiFi or wires extending through one or more walls and the roof 22. An example of a remote temperature sensing system is the TC0304, 4-Ch Thermocouple Thermometer K Type, USB output to PC for Datalog and monitoring, with 3 Meters K Type Mini-Connector Thermocouple Temperature Probe Sensor K Type Thermocouple Wire Temperature Sensing Line Measure.

Storage for valuables. Wall hung cabinets 80 for valuables, sundries and above identified accessories.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A shelter for protecting a person from fire and heat external to the shelter comprising:

a base;

a front wall extending up from the base;

a right wall extending up from the base and alongside the front wall;

a left wall extending up from the base and alongside the front wall;

a rear wall extending up from the base and alongside the front wall and the left wall and opposing the right wall;

a roof atop the front wall, the right wall, the left wall and the rear wall which together define a protected chamber from fire; the roof, the front wall, the right wall and the left wall each having a core made of a three dimensional metal matrix embedded in foam insulation with concrete positioned about the front wall, the right wall, the left wall, the rear wall and the roof; the concrete forming a continuous one piece concrete layer enveloping the roof, the front wall, the right wall, the left wall and the rear wall down to the base, the concrete layer forming a fire resistant seal with the base about the front wall, right wall, left wall, rear wall and the roof which protects the person in the chamber from the fire and heat of about 600 to about 700 degrees Fahrenheit for between about two hours to about four hours;

a heat reflective layer disposed on an external surface of each of the front wall, right wall, the left wall, the rear wall and the roof;

an inflammable layer in spaced relation to the reflective layer on each of the front wall, the right wall, the left wall, the rear wall and the roof forming an airgap between the inflammable layer and the reflective layer in each of the front wall, the right wall, the left wall, the rear wall, and the roof;

inflammable heat resistant spacers attached to and between the reflective layer and the inflammable layer of the front wall, the right wall, the left wall, the rear wall and the roof which maintain the inflammable layer in spaced relation with the reflective layer to define the airgap; and fasteners extending through the inflammable layer, the spacers, the reflective layer and the front wall, the right wall the left wall, the rear wall, and the roof to fix the inflammable layer, the spacers, and the reflective layer in place with the front wall, the right wall, the left wall, the rear wall, and the roof; and a fire-resistant door disposed in either the front wall, the right wall, the left wall or the left wall which provides access to the chamber.

2. The shelter of claim 1 including a cylinder storage section for storing compressed air cylinders to provide air to the chamber.

3. The shelter of claim 2 including plumbing disposed in the chamber to attach to the cylinders to control air flow out of the cylinders into the chamber.

4. The shelter of claim 3 including a hollow pipe extending up from the base, the pipe having a top and a bottom, the top having a one-way exhaust valve through which air from the chamber enters and vents through the pipe and out through the base, the bottom of the pipe attached to the base and in fluidic communication to outside the base.

5. The shelter of claim 4 including a release port for the compressed air from the air cylinders to flow into the chamber, the release port in fluidic communication with the plumbing.

6. The shelter of claim 5 wherein the release port is disposed adjacent the base and the rear wall, and the pipe is disposed adjacent the front wall and opposing the release port with the one-way exhaust valve adjacent the roof so isentropic cooling provided by the expansion of the compressed breathing air occurs.

7. The shelter of claim 6 wherein the inflammable layer is formed of cement board.

8. The shelter of claim 7 wherein the reflective layer disposed on the external surface of each of the front wall, right wall, the left wall, and the rear wall is one piece.

9. The shelter of claim 8 including a metal frame in the front wall to which the door is attached.

10. The shelter of claim 9 wherein the base includes a steel platform with fork pockets and a lifting eye at each corner for lifting the shelter.

11. The shelter of claim 10 wherein the core of each wall and the roof includes a three dimensional modular panel comprised of three dimensional welded wire mesh embedded in expanded and non-flammable polystyrene foam.

12. A method for protecting a person from fire and heat comprising:

providing the shelter of claim 1;

closing the fire-resistant door of the shelter; and opening valves of compressed air cylinders in the shelter to flow the compressed air from the cylinders into the chamber of the shelter.

13. A method of building the shelter according to claim 1, the method comprising:

placing the front wall on the base so the front wall is extending up from the base;

placing the right wall on the base so the right wall is extending up from the base and alongside the front wall;

placing the left wall on the base so the left wall is extending up from the base and alongside the front wall;

placing the rear wall on the base so the rear wall is extending up from the base and alongside the front wall and the left wall and opposing the right wall;

placing the roof atop the front wall, the right wall, the left wall and the rear wall which together define the protected chamber from fire; and attaching the fire-resistant door disposed in either the front wall, the right wall, the left wall or the left wall which provides access to the chamber.

* * * * *